US005823441A

United States Patent [19]

Nicholson

[11] Patent Number: 5,823,441

[45] Date of Patent: Oct. 20, 1998

[54] SHOWER GROOMING SYSTEM

[76] Inventor: Paul T. Nicholson, 427 Ave. G, #16, Redondo Beach, Calif. 90277

[21] Appl. No.: 735,124

[22] Filed: Oct. 22, 1996

[51] Int. Cl.[6] ..... B05B 7/26

[52] U.S. Cl. ..... 239/317; 239/436; 239/447; 4/605; 4/903; 601/155

[58] Field of Search ..... 239/124, 135, 239/317, 318, 436, 443, 447; 4/605, 903; 601/17, 154, 155, 159, 160, 161, 162, 165

[56] References Cited

U.S. PATENT DOCUMENTS

| | | | |
|---|---|---|---|
| 2,588,255 | 3/1952 | Larsh | 601/160 |
| 2,975,804 | 3/1961 | Dunn et al. | 239/317 |
| 3,254,647 | 6/1966 | Vogel | 239/317 |
| 3,847,354 | 11/1974 | Lemond | 239/317 |
| 3,990,612 | 11/1976 | Gasser | 222/146 |
| 4,043,337 | 8/1977 | Baugher | 601/162 |
| 4,121,773 | 10/1978 | Headen et al. | 239/317 |
| 4,203,551 | 5/1980 | Levine | 239/443 |
| 4,265,229 | 5/1981 | Rice et al. | 601/155 |
| 4,564,005 | 1/1986 | Marchand et al. | 601/165 |
| 4,601,709 | 7/1986 | Kabbaby | 604/150 |
| 4,793,331 | 12/1988 | Stewart | 601/155 |
| 4,911,704 | 3/1990 | Dixon | 239/447 |
| 4,991,569 | 2/1991 | Martin | 601/155 |
| 5,004,158 | 4/1991 | Halem et al. | 239/443 |
| 5,060,829 | 10/1991 | Evans | 222/146.1 |
| 5,153,962 | 10/1992 | Ritter | 15/28 |
| 5,218,956 | 6/1993 | Handler et al. | 601/155 |
| 5,220,914 | 6/1993 | Thompson | 601/155 |
| 5,241,714 | 9/1993 | Barry | 4/605 |
| 5,333,789 | 8/1994 | Garneys | 4/903 |
| 5,339,469 | 8/1994 | Gilles | 239/447 |
| 5,564,629 | 10/1996 | Weissman et al. | 239/317 |
| 5,634,890 | 6/1997 | Morris | 601/155 |

*Primary Examiner*—Andres Kashnikow
*Assistant Examiner*—Lisa Ann Douglas
*Attorney, Agent, or Firm*—Roger A. Marrs

[57] ABSTRACT

A system having a diverter valve installed between a source of pressurized water and a dispensing shower head for conducting a portion of water from the main flow to an article or device of personal hygiene. The valve may include a return port for conducting water from the device back to the valve for discharge with the main flow through the shower head. A venturi is included in the valve for controlling the main flow and for water conservation.

1 Claim, 3 Drawing Sheets

SHOWER GROOMING SYSTEM

FIELD OF THE INVENTION

The present invention relates to the field of bath accessories, and more particularly it relates to attachments for existing shower installations for providing one or more personal hygiene devices that can be used while showering, including a shaving cream heater, tooth and gum cleaner, tooth and gum jet sprayer, and a feminine douche system, all of which obtain the required motive energy and heat from shower water flow without requiring any additional energy sources.

BACKGROUND OF THE INVENTION

The conventional shower stall is a convenient and suitable location for performing other personal grooming activities such as shaving, brushing and/or massaging the teeth and gums, and female douching. Devices requiring connection to an AC power line, e.g. a warming cup for shaving cream, would be highly unsuited to use in a shower because of shock hazard. Battery operated devices are less than ideal due to the problems of potential corrosion and the need to replace and/or recharge batteries.

However, water flow in the conventional shower constitutes a potential source of kinetic energy that can provide motive force for mechanical moving devices; and when the water is hot, thermal energy is available for warming purposes. The present invention discloses a novel family of personal grooming accessories for which the household shower is tapped as a source of moderated water flow, mechanical energy and warming heat for their operation.

DISCUSSION OF RELATED KNOWN ART

U.S. Pat. No. 3,990,612 to Gasser discloses an electrically powered heating apparatus for providing heated lather.

U.S. Pat. No. 5,060,829 to Evans discloses a product conditioning unit that heats and moisturizes a pressurized product by direct contact with water.

U.S. Pat. Nos. 5,218,956 to Handler et al, 4,991,569 to Martin, 4,793,331 to Stewart, 5,153,962 to Ritter and 4,265,229 to Rice disclose apparatus adapted to a shower head for cleaning the teeth and gums while showering.

U.S. Pat. No. 4,601,709 to Kabbaby discloses a shower-mounted douche apparatus that supplies a douche applicator with a mixture of water and medicament from a mixing head.

OBJECTS OF THE INVENTION

It is a primary object of the present invention to provide a user with a system of various personal hygiene devices and associated adapters for insertion at a shower head that enable the devices to receive all required water flow, motive power and heat from the flow of shower water, instead of utilizing electric energy generated by fossil or nuclear fuels.

It is a further object to provide the user with a water source to heat shaving cream instead of an electric source.

It is a further object to provide the user with a controlled water source to clean and massage the user's teeth and gums instead of an electric source.

It is a further object to provide the user with a douche wash system including a temperature-controlled and flow-controlled stream of water that mixes with a solution for the douche wash instead of using a limited source of water from a bag, and/or douche solution bottle.

SUMMARY OF THE INVENTION

The abovementioned objects have been accomplished by the present invention by the provision of two types of water flow diverters that are easily added to existing shower installation ahead of the shower head and which do not require any additional energy source such as electricity, and by the provision of a set of corresponding personal hygiene shower accessory devices that operate from the diverted shower water flow.

BRIEF DESCRIPTION OF THE DRAWINGS

The above and further objects, features and advantages of the present invention will be more fully understood from the following description taken with the accompanying drawings in which.

DETAILED DESCRIPTION

Figure 1A:
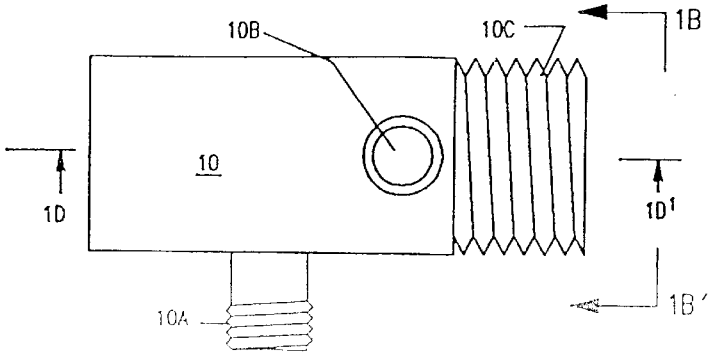
FIG. 1A is an elevational view of a returned-flow-diversion shower head adaptor of the present invention having two auxiliary ports: an outlet port and a return for a closed diverted water flow path.

FIG. 1A is an elevational view showing a shower head returned-flow-diversion adaptor 10 of the present invention that provides a diverted water flow path at an auxiliary outlet port 10A and includes an auxiliary flow return port 10B for returning the diverted water to the main outflow which exits through the threaded portion 10C at the right. The threaded port fittings 10A and 10B are shown for example only in this and following embodiments: these may be implemented in other configurations known and available in industry and trade.

Figure 1B:
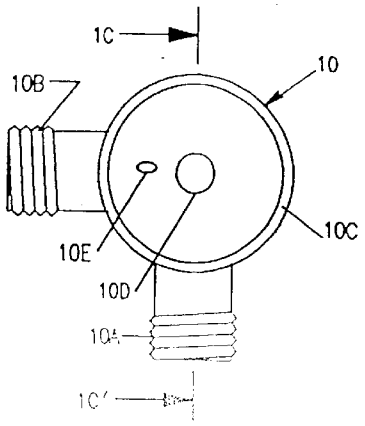
FIG. 1B is view of the right hand end of adaptor of FIG. 1A, viewed through axis 1B–1B' thereof.

FIG. 1B is an end view of adaptor 10, viewed from the right of FIG. 1, showing auxiliary outlet port 10A, auxiliary return port 10B, an internal venturi passageway 10D and an internal return passageway 10E.

Figure 1C:
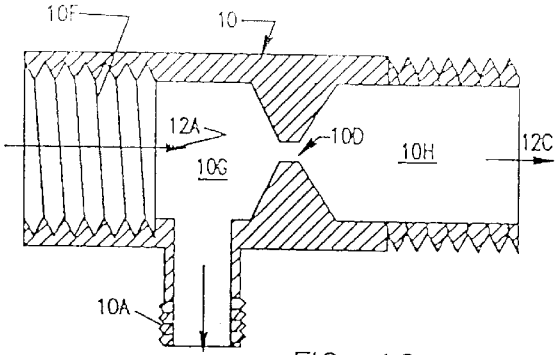
FIG. 1C is a cross-sectional view of the adaptor from the same viewpoint as in FIG. 1A, taken through central axis 1C–1C' of FIG. 1B.

FIG. 1C is a cross-sectional view of adaptor 10 as seen from the same viewpoint as FIG. 1, taken through central axis 1C–1C' of FIG. 1B. The main inflow, arrow 12A, enters through an internally-threaded main intake region 10F that fits onto a standard threaded showerhead supply pipe. Region 10F leads to an intake chamber 10G from which a portion of the inflow 12A in diverted path 12B exits chamber 10G through an auxiliary outlet port 10A. Flow in the input chamber 10G is narrowed to the venturi passageway 10D and then widened again as it enters the outlet chamber 10H where the main shower outflow is indicated by arrow 12C.

Figure 1D:
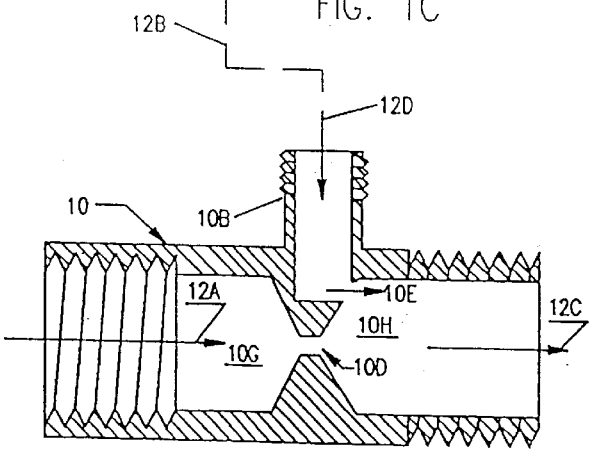
FIG. 1D is a cross-sectional view of the adaptor taken through axis 1D–1D' of FIG. 1A.

FIG. 1D is a cross-sectional view of adaptor 10 taken through central axis 1D–1D' of FIG. 1A. Auxiliary return flow, indicated by arrow 12D, enters via return port 10B and is drawn into the outlet chamber 10H through passageway 10E. As indicated by dashed line 12B–12D, auxiliary input flow 12D originates as the auxiliary output flow path (12B FIG. 1C) from input chamber 10G. Flow line 12B–12D, typically passes through a non-contaminating device such as a shaving cream warming jacket.

In the main flow path, arrows 12A and 12C, the water pressure in input chamber 10G tends to be elevated due to the constriction introduced by the small venturi passageway 10D and its tapered entry region. Conversely as the water exits the venturi passageway 10D, the increasing flow diameter causes a reduction in fluid pressure in outlet region 10H, thus assisting the diverted return flow 12D.

Figure 2A:
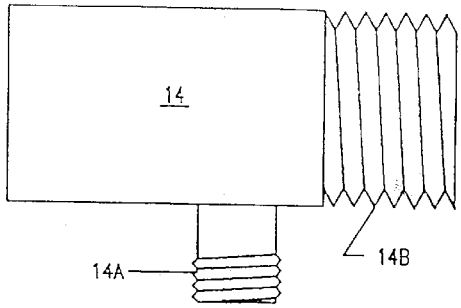
FIG. 2A is an elevational view of an unreturned-flow-diversion shower head adaptor of the present invention having an auxiliary outlet port for a diverted water flow path.

FIG. 2A is an elevational view of a unreturned-flow-diversion shower head adaptor 14 which, like adaptor 10 of FIG. 1A, fits between a conventional shower head and its plumbed supply pipe, and-provides, in addition to the main shower flow path, a diverted flow path from an auxiliary outlet port 14A. However, there is no auxiliary return port: instead the auxiliary flow is intended to escape externally, typically via the shower drain, since it typically includes potentially contaminated wastewater from body-hygienic cleaning.

Figure 2B:
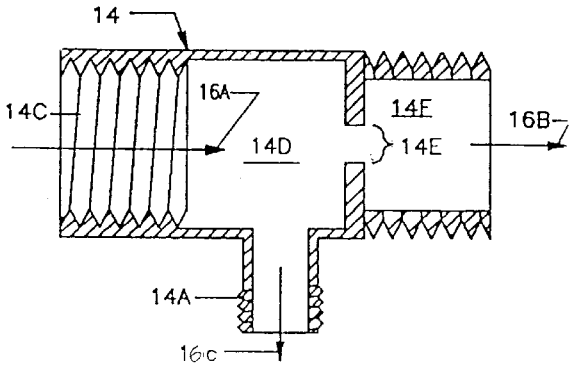
FIG. 2B is a cross-sectional view of the adaptor of FIG. 2A taken through its central axis from the same viewpoint as in FIG. 2A.

FIG. 2B is a cross-sectional view of adaptor 14 taken from the same viewpoint as in FIG. 2A at a plane through its central axis. The main input flow, arrow 16A, enters through the internally-threaded entry region 14C to the intake chamber 14D where diverted flow, arrow 16C, exits via auxiliary outlet port 14A. The remaining main flow is forced through aperture 14E into the outlet chamber 14F where the outflow, arrow 16B, proceeds to the shower head. Aperture 14A acts to provide sufficient pressure in the diverted path 16C and also tends to conserve water by reducing the flow rate of the main shower path 16B.

In general the invention is implemented by inserting an adaptor unit such as adaptor 10 (FIG. 1A) or 14 (FIG. 2A) between an existing shower head, fixed or swivel type and its normal existing water source, which may be a fixed, wall-mounted pipe or the flexible hose of a shower hand-held type of shower head.

In illustrative working embodiments of adapters 10 and 14, shown in FIGS. 1A and 2A, the housing is dimensioned to attach to the shower water source: e.g. for ½" FPT threaded shower pipe, the housing could be made to have ⅞" outside diameter. Referring to FIGS. 1C–D, the venturi passageway 10D in adaptor 10 could be made 1/81 diameter and ⅛" long and the return passageway 10E is made ⅛" in diameter. In FIG. 2B the aperture 14F in adaptor 14 is made ⅛" in diameter. In FIGS. 1A–2B all of the auxiliary ports (10A, 10B and 14A) could be implemented as standard ¼" hose fittings, or auxiliary ports could be built into each module.

Figure 3:
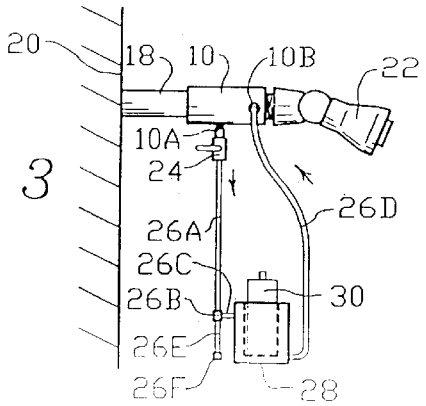
FIG. 3 is a side view of a wall-mounted shower head installation fitted with the adaptor of FIG. 1A in operational connection with a shaving cream warmer.

FIG. 3 is a side view of an illustrative embodiment of the present invention, implemented by a returned adapter as in FIGS. 1A–D, showing a wall-mounted shower head installation having a returned-flow-diversion adaptor 10 of FIG. 1A–D installed between a plumbed shower pipe 18, mounted in a wall 20, and a conventional swivel (or fixed) showerhead 22. Adaptor 10 could also be installed immediately upstream of a hand held shower head.

A shutoff valve 24, which can be fitted onto auxiliary outlet port 10A as shown, or built into the shaving cream module, directs the diverted flow through hose 26A, tee 26B and hose 26C to a warming jacket 28 which hosts a shaving cream container 30 to be warmed. An auxiliary return flow hose 26D returns water from unit 28 to auxiliary return port 10B in adaptor 10. Warming jacket 28. Warming jacket 28 is made to have a closed flow path and is designed for good heat conductivity to container 30 to avoid slow warmup.

Alternatively warming jacket 28 could be made open at the top and operated with container 30 in direct contact with the auxiliary water flow through unit 28, however such an open system requires careful flow regulation to ensure adequate flow without overflowing.

Facilities may be provided for future connection to additional attachments: e.g., as shown, a short hose 26E, from tee 26B, closed by a plug cap 26F.

In an alternative configuration, functionally equivalent to FIG. 3, warming unit 28 can be integrated with adaptor 10, located on top or a side thereof, so as to eliminate some or all of the hoses and fittings 26A–26F.

Figure 4:
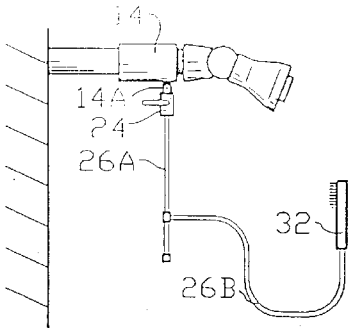
FIG. 4 is a side view of a wall-mounted shower head installation fitted with the adaptor of FIG. 2A in operational connection with a gum cleaning and massaging attachment.

FIG. 4 is a side view of a wall-mounted shower head installation having an unreturned-flow-diversion adaptor 14 of FIG. 2A installed, as in FIG. 3, between a plumbed wall-mounted shower pipe and a conventional showerhead. The diverted flow from auxiliary outlet port 14A proceeds through valve 24 and hoses 26A and 26B to a gum cleaning and massaging attachment 32, which may utilize brushes that rotate from the water flow.

Figure 5:
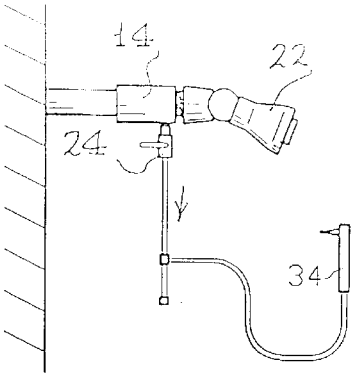
FIG. 5 is a side view-of a wall-mounted shower head installation fitted with the adaptor of FIG. 2A in operational connection with a tooth and gum spray attachment.

FIG. 5 is a side view of a wall-mounted shower head installation as in FIG. 4 except that in place of attachment 32 the shower accessory item is a tooth and gum spray attachment 34 having a conical nozzle.

Typically in this and other illustrative embodiments, auxiliary water flow is conducted in ¼" flexible hoses as a matter of ready availability; however other sizes could be utilized.

Figure 6:
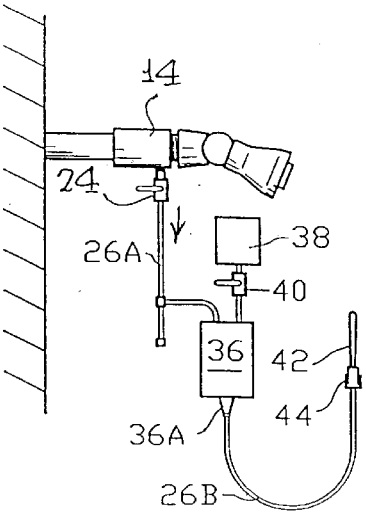
FIG. 6 is a side view of a wall-mounted shower head installation fitted with the adaptor of FIG. 2A in operational connection with a douche device.

FIG. 6 is a side view of a wall-mounted shower head installation as in FIGS. 4 and 5 except that the shower accessory item is a douche system for female users, consisting of a mixing chamber 36 receiving the diverted water flow from adaptor 14 via hose 26A, and receiving medicated additive fluid from an overhead container 38 via valve 40 which can regulate and turn off the flow of additive fluid. The mixture from chamber 36 is delivered to douche delivery element 42 via hose adaptor 36A at the bottom of chamber 36 and hose 26B, which is fitted with an adaptor 44 that makes element 42 detachable.

In this and any of the installations the modules and valving can built into the adaptor housing to make them individual modules where they would not need hoses or detached valves.

Figure 7A:
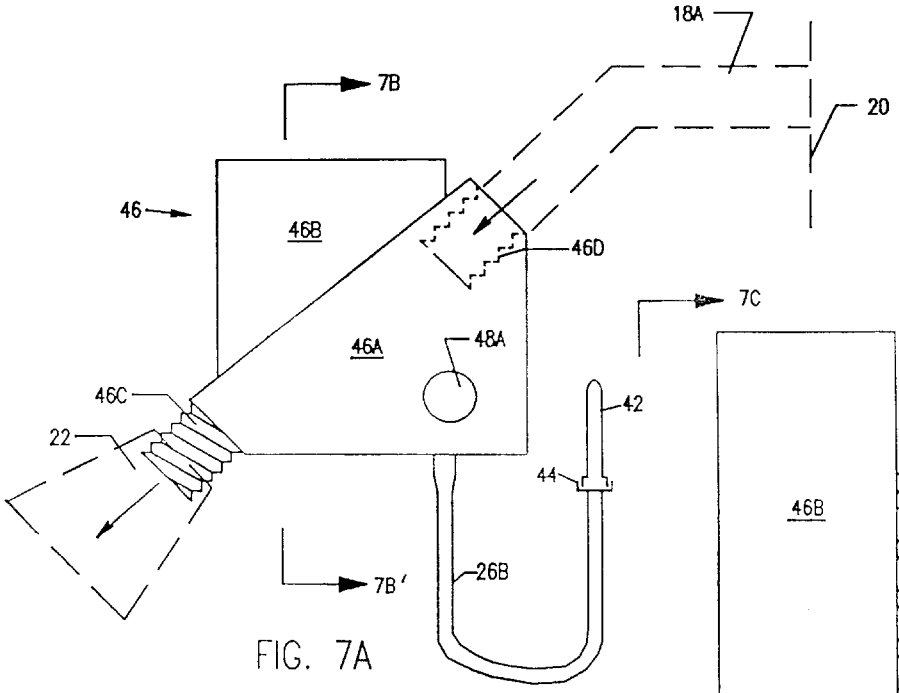
FIG. 7A is a side elevation of a wall-mounted shower head installation of a douche device and associated integrated adaptor/dispenser embodiment of the present invention.

FIG. 7A is a side elevation of a douche embodiment of the present invention that eliminates interconnecting hoses of the previously described douche embodiment by forming an integrated douche adaptor assembly 46 having a solution container portion 46B integrally attached to a main adaptor body 46A which is shown installed between the conventional shower components shown in dashed outlines: shower head 22 and shower pipe 18A, shown as curved in this instance, coming from wall 20. The only hose, 26B, leads downwardly to the douche delivery element 42, detachable at fitting 44. A water-mixing valve control knob 48A is located on the side of main adaptor body 46A as shown.

Figure 7B:
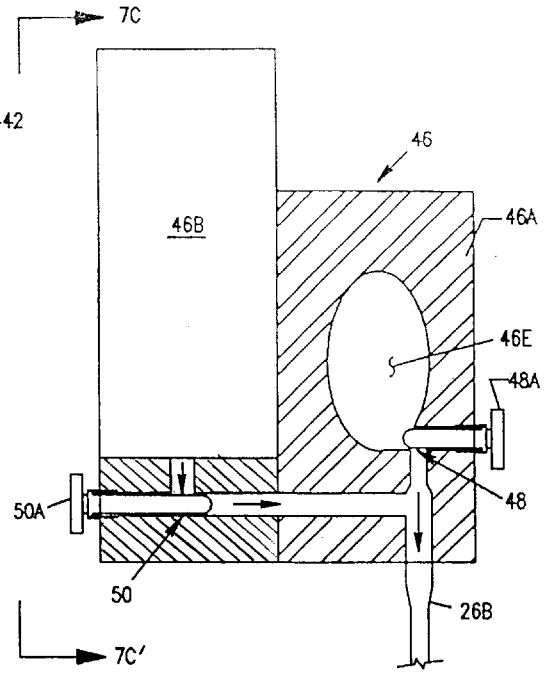
FIG. 7B is a slightly enlarged cross-section of the subject matter of FIG. 7A taken at axis 7B–7B'.

FIG. 7B is a slightly enlarged cross-section of the integrated douche adaptor assembly 46 of FIG. 7A taken at axis 7B–7B'. In the main body 46A is seen the main shower water passageway 46E, leading at the bottom to a water-mixing valve 48 that can be controlled by water-mixing knob 48A for adjusting the water flow to hose 26B, and thence to douche delivery element 42 (FIG. 7A). At the bottom region of solution container portion 46B a solution-mixing valve 50, controlled by user solution-mixing knob 50, allows adjustment of the flow of solution from the main solution container of portion 46B.

In normal usage, both valves 48A and 50A remain closed whenever the douche element 42 is not in use. To use the douche, valve 48 is first opened by knob 48A so as to obtain a desired flow rate at element 42, then the water temperature is adjusted in the regular manner until it is the right temperature at element 42. Then valve 50 is opened by knob 50A which is adjusted to provide the desired rate of dispensing solution from the solution storage chamber in portion 46B. When douching is finished, both valves 48 and 50 are closed by their respective knobs, 48A and 50A.

Figure 7C:
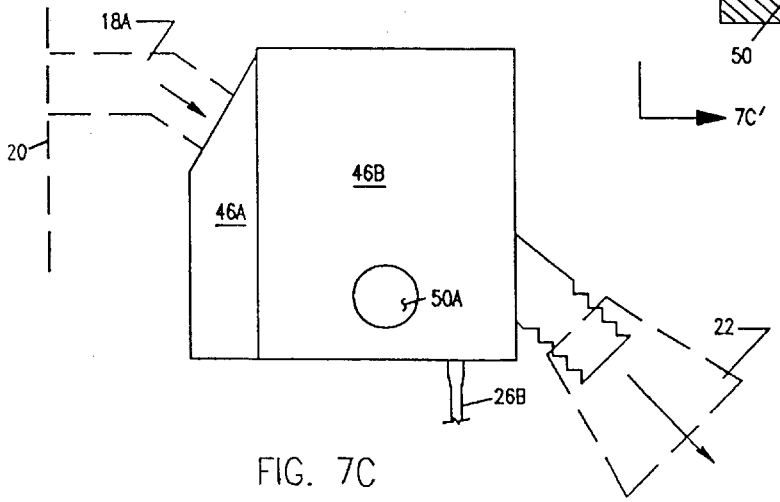
FIG. 7C is side elevation of the subject matter of FIGS. 7A–B as viewed from axis 7C–7C" of FIG. 7B, showing the side opposite that shown in FIG. 7A.

FIG. 7C is side elevation of the assembly 46 of FIGS. 7A–B as viewed from axis 7C–7C' of FIG. 7B, showing the side opposite that shown in FIG. 7A, with portion 46B and knob 50A.

FIGS. 7A–7C are illustrative of the manner in which modules and valving of the present invention can be integrated into a main adaptor housing in order to eliminate the need for interconnecting hoses or detached valves.

It should be apparent that the components of FIGS. 3–6, and/or the integrating principle of FIGS. 7A–7C can be combined in various ways to configure a custom shower accessory installation having one or more of the accessories as taught by this invention.

The invention can be practiced with two (or more) adapters, such as 10, 14 and 46 inserted in tandem between the pipe 18/18A and the shower head 22.

The invention can be practiced with hoses eliminated or with hoses 26A, 26B, etc. of various length, routing and interconnection arrangements suited to particular installations ranging from simple addition in series with the shower head as described above to more elaborate installations which could include, for example, wall-mounted holders and components, permanent plumbing and possible wall-enclosure of auxiliary hoses or pipelines.

The invention can be successfully practiced with numerous variations in internal and external dimensioning and mechanism of the adapters, locations of ports, type and placement of valves, and circulation pattern of water, e.g. in the shaving cream warmer and douche wash.

The invention may be embodied and practiced in other specific forms without departing from the spirit and essential characteristics thereof. The present embodiments are therefore to be considered in all respects as illustrative and not restrictive.

What is claimed is:

1. The A diverter adapter comprising an elongated cylindrical body having opposite open ends with threaded coupling means on each of said ends;

a central barrier disposed in said body between said opposite open ends and defining an intake chamber associated with a first end of said opposite open ends and an outlet chamber associated with a second end of said opposite open ends;

said central barrier having a central orifice defined by a circular converging wall surface terminating at said central orifice;

a central venturi including said central orifice in said barrier connecting said intake chamber with said outlet chamber;

an internal venturi return passageway of reduced size as compared with said central venturi passageway;

an auxiliary flow outlet on said body communicating said intake chamber exteriorly of said body;

a personal hygiene device detachably coupled to said auxiliary flow outlet for receiving diverted flow from said intake chamber;

a source of pressurized fluid detachably coupled to said first end of said body;

a discharge means detachably coupled to said second end of said body; and a return flow port connecting said personal hygiene device to said outlet chamber whereby fluid from said pressurized fluid source is diverted from said intake chamber to circulate and heat and return to said outlet chamber.

* * * * *